US011808184B2

(12) United States Patent
Lane

(10) Patent No.: US 11,808,184 B2
(45) Date of Patent: Nov. 7, 2023

(54) LUBRICATION SYSTEM FOR INTERNAL COMBUSTION ENGINE

(71) Applicant: Wacker Neuson America Corporation, Menomonee Falls, WI (US)

(72) Inventor: John Lane, Hartford, WI (US)

(73) Assignee: Wacker Neuson America Corporation, Menomonee Falls, WI (US)

( * ) Notice: Subject to any disclaimer, the term of this patent is extended or adjusted under 35 U.S.C. 154(b) by 0 days.

(21) Appl. No.: 17/547,551

(22) Filed: Dec. 10, 2021

(65) Prior Publication Data

US 2023/0120773 A1 Apr. 20, 2023

Related U.S. Application Data

(60) Provisional application No. 63/257,871, filed on Oct. 20, 2021.

(51) Int. Cl.

| | |
|---|---|
| ***F01M 11/00*** | (2006.01) |
| ***F01M 1/02*** | (2006.01) |
| ***F01M 11/02*** | (2006.01) |

(52) U.S. Cl.

CPC ..... *F01M 11/0004* (2013.01); *F01M 1/02* (2013.01); *F01M 11/02* (2013.01); *F01M 2011/0095* (2013.01)

(58) Field of Classification Search

CPC ..... F01M 11/0004; F01M 1/02; F01M 11/02; F01M 2011/0095; F24J 3/006; F01N 5/02

See application file for complete search history.

(56) References Cited

U.S. PATENT DOCUMENTS

| | | | | |
|---|---|---|---|---|
| 4,995,357 | A * | 2/1991 | Gonnering | F01M 11/12 123/196 S |
| 6,213,080 | B1 | 4/2001 | Marsh et al. | |
| 7,686,136 | B2 * | 3/2010 | Evans | F01M 11/04 184/6.5 |
| 10,502,104 | B2 * | 12/2019 | Dawson | B01D 19/0031 |
| 2019/0032527 | A1 * | 1/2019 | May | F01M 11/12 |

* cited by examiner

*Primary Examiner* — Syed O Hasan

(74) *Attorney, Agent, or Firm* — Boyle Fredrickson S.C.

(57) ABSTRACT

A lubrication system for a machine such as a mobile generator, a mobile light tower, or a mobile jobsite heater implements an engine oil supplementation strategy from an auxiliary sump to increase service time between engine oil servicing tasks of an internal combustion engine. The system periodically introduces a supplemental volume of oil from an auxiliary sump into the engine's lubricating system during an oil supplement event. The fluid communication between the engine sump and auxiliary sump may be achieved through multiple sump connections, which may include a sump-to-sump return line that provides a liquid connection allowing oil to freely flow between the engine sump and the auxiliary sump and a vent line that provides a gaseous connection between a void space at an upper end of the auxiliary sump and a void space at an upper end of the engine sump.

20 Claims, 7 Drawing Sheets

LUBRICATION SYSTEM FOR INTERNAL COMBUSTION ENGINE

CROSS-REFERENCE TO A RELATED APPLICATION

This application claims priority under 35 USC § 119(e) to prior provisional patent application Ser. No. 63/257,871, filed Oct. 20, 2021 and entitled LUBRICATION SYSTEM FOR INTERNAL COMBUSTION ENGINE, the contents of which are hereby incorporated by reference in their entirety.

BACKGROUND OF THE INVENTION

1. Field of the Invention

The present invention relates to internal combustions engines and, more particularly, to engine lubrication systems. Still more particularly, the invention relates to lubrication systems with auxiliary oil storage and to machines powered by such engines.

2. Discussion of the Related Art

Commercial and industrial machines that are towable to jobsites for stationary use while at the jobsites are known and continuing to gain popularity because of their ability to, for example, extend work time periods. Such machines require routine maintenance, such as oil changes, which are typically tracked based on a runtime service schedule. Efforts have been made to simplify oil changes by improving access to drain plugs and fill openings. However, even with improved access to drain plugs and fill openings, oil changes still require machine downtime as well as time and effort of the operator. Furthermore, the oil change timing is often required when the machine is at a jobsite. Performing oil changes at a jobsite are less convenient and typically take more time than performing them in a shop. Jobsites often may be located at remote locations in harsh environments that hinder oil changes. Machines that must operate at such jobsites include ground heaters, generators, and light towers.

Other efforts have been made to extend the amount of time between oil changes. Some of these include providing different chemistries of the oil and/or their additive packs to provide longer-life oil. However, these modified oils are expensive. Other efforts include increasing the volume of oil to increase the oil's service life. This typically includes removing a stock oil pan from the engine and replacing it with a higher capacity oil pan. This adds time, expense, and changes the form factor of the engine package, which can compromise some engine installations by creating, for example, clearance issues with other structures in an engine compartment. Increased oil volumes also lead to longer periods of cold oil circulation and the attendant operational drawbacks.

Thus, it would be desirable to provide a lubrication system for an internal combustion engine that can extended the time period of the engine oil service schedule.

SUMMARY OF THE INVENTION

In accordance with a first aspect of the invention, at least some of the above-discussed challenges are addressed by a lubrication system that increases the oil capacity without requiring replacement of an engine's oil pan with a larger capacity oil pan.

In accordance with another aspect of the invention, a lubrication system provides an extended oil-service life to increase the service time between engine oil servicing tasks of an internal combustion engine.

In accordance with another aspect of the invention, the lubrication system provides the extended oil-service life by implementing an oil supplementation strategy that increases the overall volume of oil available for lubrication.

In accordance with another aspect of the invention, the system periodically introduces a supplemental volume of oil from an auxiliary sump into the engine's lubricating system. The engine may have a wet sump configuration and the auxiliary sump may be in free fluid communication with the engine sump. The fluid communication between the engine sump and auxiliary sump may be achieved through multiple sump connection, which may include a sump-to-sump return line that provides a liquid connection allowing oil to freely flow between the engine sump and the auxiliary sump and a vent line that provides a gaseous connection between a void space at an upper end of the auxiliary sump and a void space at an upper end of the engine sump.

In accordance with another aspect of the invention, the cumulative oil supplement events periodically turn-over the entire volume of oil used in the active lubrication of the engine's moving parts.

In accordance with another aspect of the invention, during each oil supplement event, a volume of the oil is removed from the auxiliary sump and added to the engine sump, creating a temporary oil level differential between the sumps. Following the oil supplement event, the lubrication system enters a level-restoration phase, during which the oil level differential reduces until the levels equalize to the base oil levels of the engine oil and auxiliary oil.

In accordance with another aspect of the invention, the system monitors the engine oil level to ensure that while experience the oil level differential or at other times, the engine has an appropriate amount of oil within an oil level target range. A switch system may shut off the engine if the detected engine oil level falls below a lower threshold value or above an upper threshold value of the target range.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION

Figure 1:
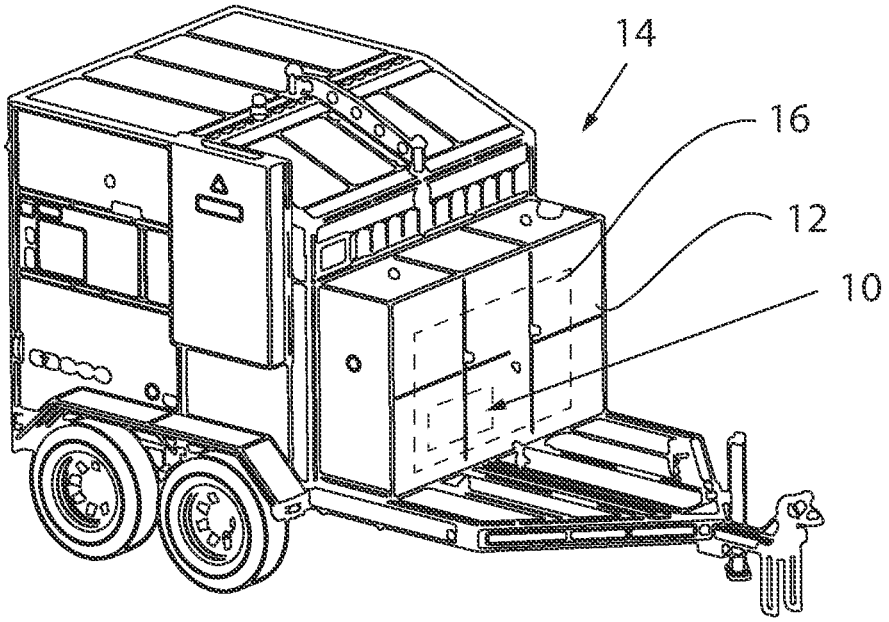
FIG. 1 is a pictorial view of an industrial machine with an internal combustion engine having a lubrication system according to aspects of the invention.

Referring now to FIG. 1, in accordance with an aspect of the invention, a lubrication system for an internal combustion engine is represented as system 10, shown here is shown implemented in a power unit 12 of a commercial or industrial machine 14. Exemplary commercial or industrial machines 14 include various towable machines such as mobile generators, mobile light towers, mobile jobsite heaters (typically called "ground heaters"), and/or other machines available from Wacker Neuson America Corporation of Menomonee Falls, Wis. Regardless of the particular machine 14 in which power unit 12 is implemented, power unit 12 includes an internal combustion engine 16, which is typically a diesel internal combustion engine having a rated output of between about 5 hp to about 165 hp and more typically of between 5 hp and 20 hp. Engine 16 may be implemented as a fixed speed engine or as an engine with a narrow rated operational speed range of within about 500 rpm (rotations per minute) of a target speed. Typically, engine 16 has an operational speed range of between about 1,200 rpm and 2,500 rpm, more typically between about 1,500 rpm and 2,200 rpm, and most typically a fixed rated speed of about 1,800 rpm (plus or minus 10-percent).

Figure 2:
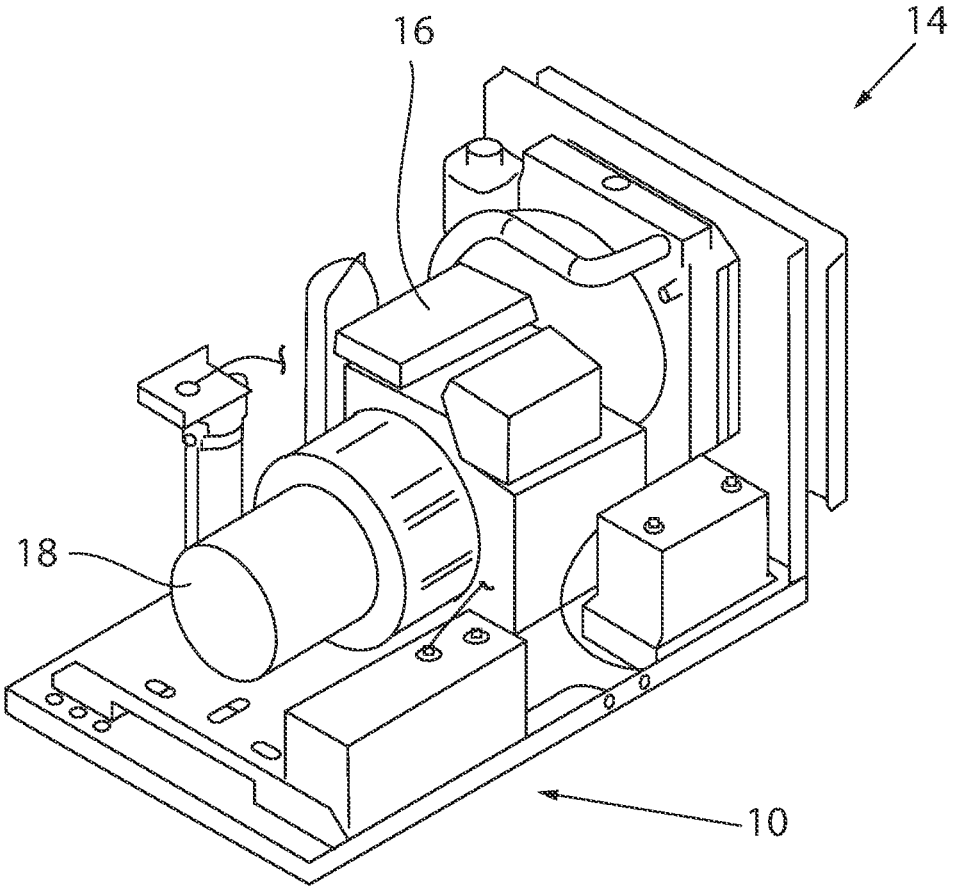
FIG. 2 is a schematic pictorial view of the system in portions of the industrial machine shown in FIG. 1.

Referring now to FIG. 2, power unit 12 is represented here as a generator implementation, with engine 16 acting as a prime mover to power a genset 18 that creates electrical power. In the case of a light tower, the genset provides power to lights mounted on an extendible mast. The power unit also could comprise a heater. Regardless of the particular implementation of power unit 12 and/or machine 14, each system 10 is configured to provide additional or supplemental oil to extend the oil service life of the engine 16.

Figure 3:
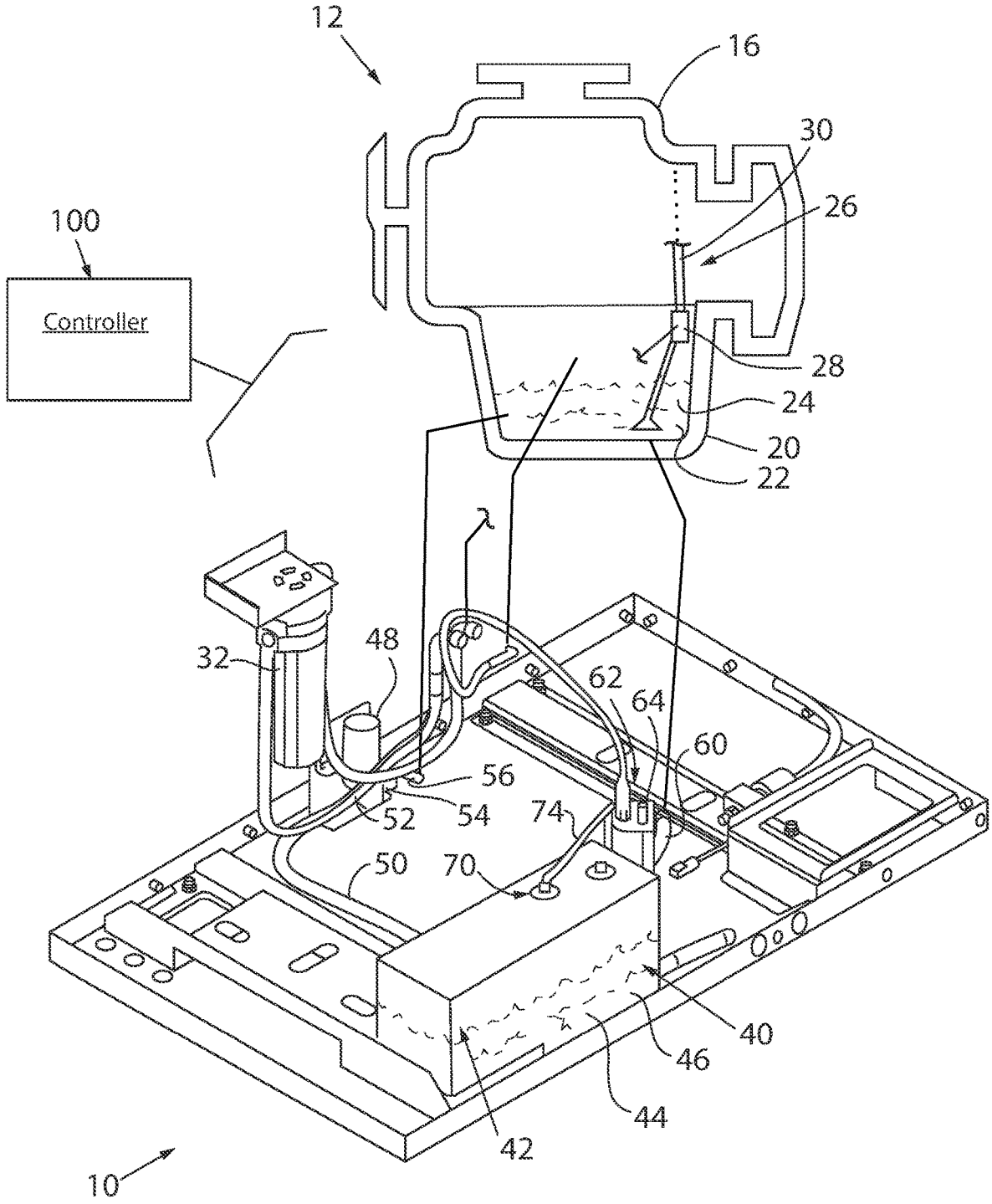
FIG. 3 is a schematic partially exploded view of the system implemented with an internal combustion engine.

Referring now to FIG. 3, each engine 16 has an oil pan 20 than defines an engine sump 22 that holds a primary volume of oil 24, which is circulated through an internal lubrication system 26 of the engine 16. The engine's internal lubrication system 26 includes oil pump 28 that pulls engine oil or primary oil 24 out of the engine sump 22 and delivers it through engine oil passages 30 that direct oil to lubricate moving components of engine 16. The oil 24 is further directed through an oil filter, shown here as remote oil filter 32, while circulating through the internal lubrication system 26.

Still referring to FIG. 3, an auxiliary oil delivery system 40 is configured to periodically deliver doses or volumes of oil into the engine's internal lubrication system 26. Auxiliary oil delivery system 40 is connected to the engine's internal lubrication system 26 through multiple connection points and includes an auxiliary oil container or tank 42 that defines an auxiliary sump 44 that holds an auxiliary volume of oil 46, a portion(s) of which is periodically dosed or supplementally added to the primary oil 24. Auxiliary oil pump 48 is configured to deliver the supplemental amount of the auxiliary volume of oil 46 from the auxiliary sump 44 to the engine sump 22. Typically, the auxiliary sump 44 has a greater storage capacity and/or holds a greater volume of oil than engine sump 22. Most typically, auxiliary sump 44 hold at least twice the amount of oil that engine sump 22 holds, whereby the overall system 10 has an oil storage capacity of at least a multiple of at three than a capacity of the engine sump 22, alone. Providing the auxiliary sump 44 with twice the storage capacity as the engine sump 22 triples the oil storage capacity of the system, effectively tripling the time required between oil changes.

Still referring to FIG. 3, auxiliary oil pump inlet line 50 connects an outlet of the tank 42 to the auxiliary oil pump's 48 inlet 52. An outlet 54 of auxiliary oil pump 48 is connected to an auxiliary oil pump outlet line 56 that is connected to the engine's oil pan or engine sump 22. A liquid connection(s) provides a sump connector(s) between the engine sump 22 and auxiliary sump 44. This may be defined by or include a sump-to-sump return line 60, which defines a return flow path for the oil to flow for passively equalizing the oil levels in the engine sump 22 and auxiliary sump 44. The sump-to-sump return line 60 may be segmented, with the portions or segments 60*a*, 60*b* (FIG. 5) portions separated by a switch system 62, shown as including switch 64 that is configured to determine oil level within system 10. A vent 70 is shown that includes a vent line 74 that provides a vent passage that extends between and connects an interior of the auxiliary sump 44 to an interior of engine 16, typically venting the auxiliary sump 44 to the engine sump 22. This may be achieved by connecting the vent line 74 to a dipstick tube of engine 16, such as through a T-connector at the top of the dipstick tube. Through connections of between the auxiliary oil delivery system 40 and the engine's internal lubrication system 26, a liquid connection allows oil to freely flow between the engine sump 22 and the auxiliary sump 44 with the vent line 74 provides a gaseous connection between a void space at an upper end of the auxiliary sump 44 and a void space at an upper end of the engine sump 22.

Still referring to FIG. 3, control system 100 controls operation of system 10. Control system 100 may be implemented as part of an overall control system of machine 14 or as a standalone system that controls operations characteristics of the system 10, which may include controlling various operational aspects of engine 16 alone or along with other features or components of power unit 12. Control system 100 may include a computer that executes various stored programs while receiving inputs from and sending commands to the subsystems of or components of system 10 in order to provide the periodic dosing or supplemental delivery of oil from the auxiliary sump 44 to the engine sump 22.

Figure 4:
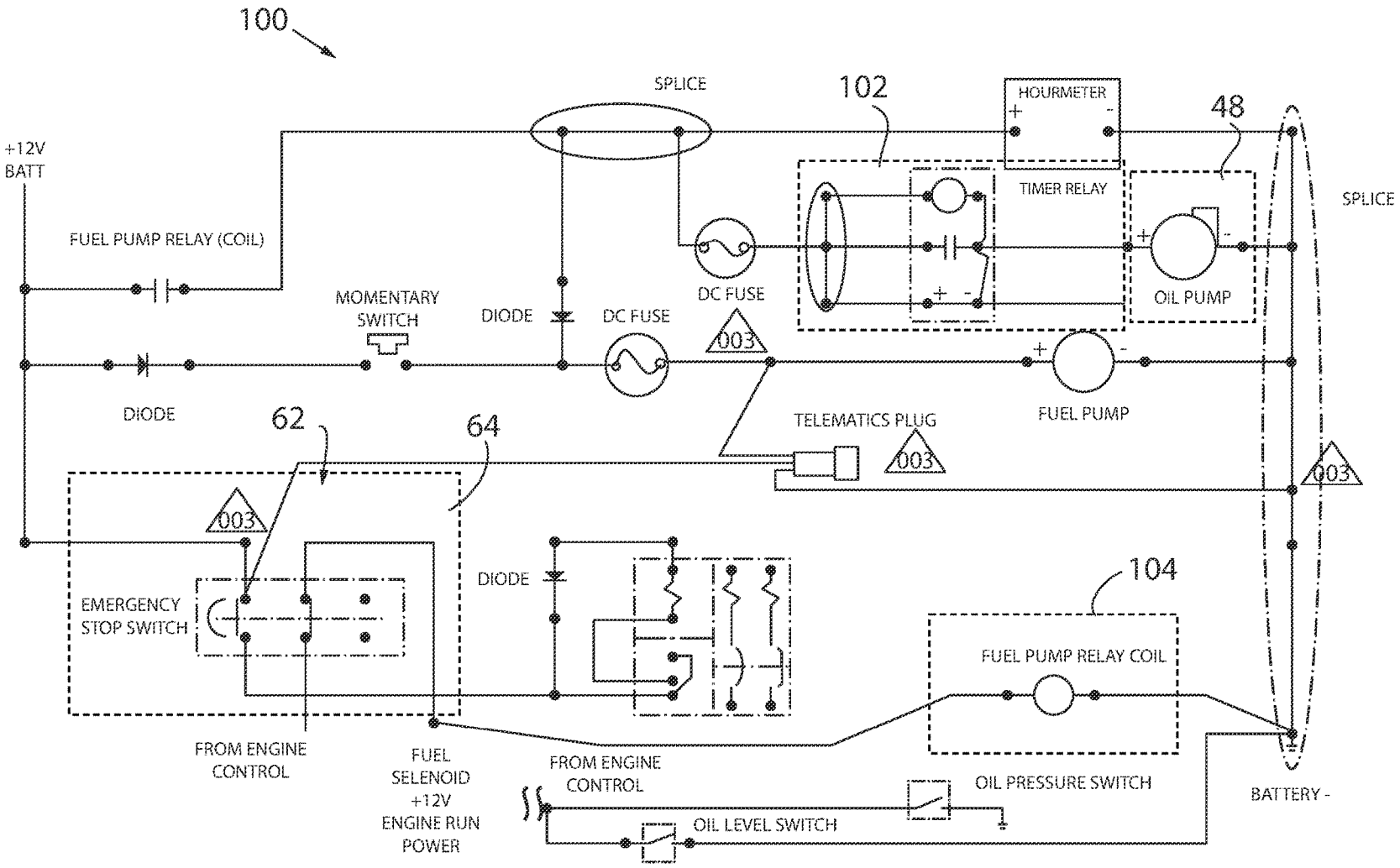
FIG. 4 is a schematic layout of various components within the system.
Figure 5:
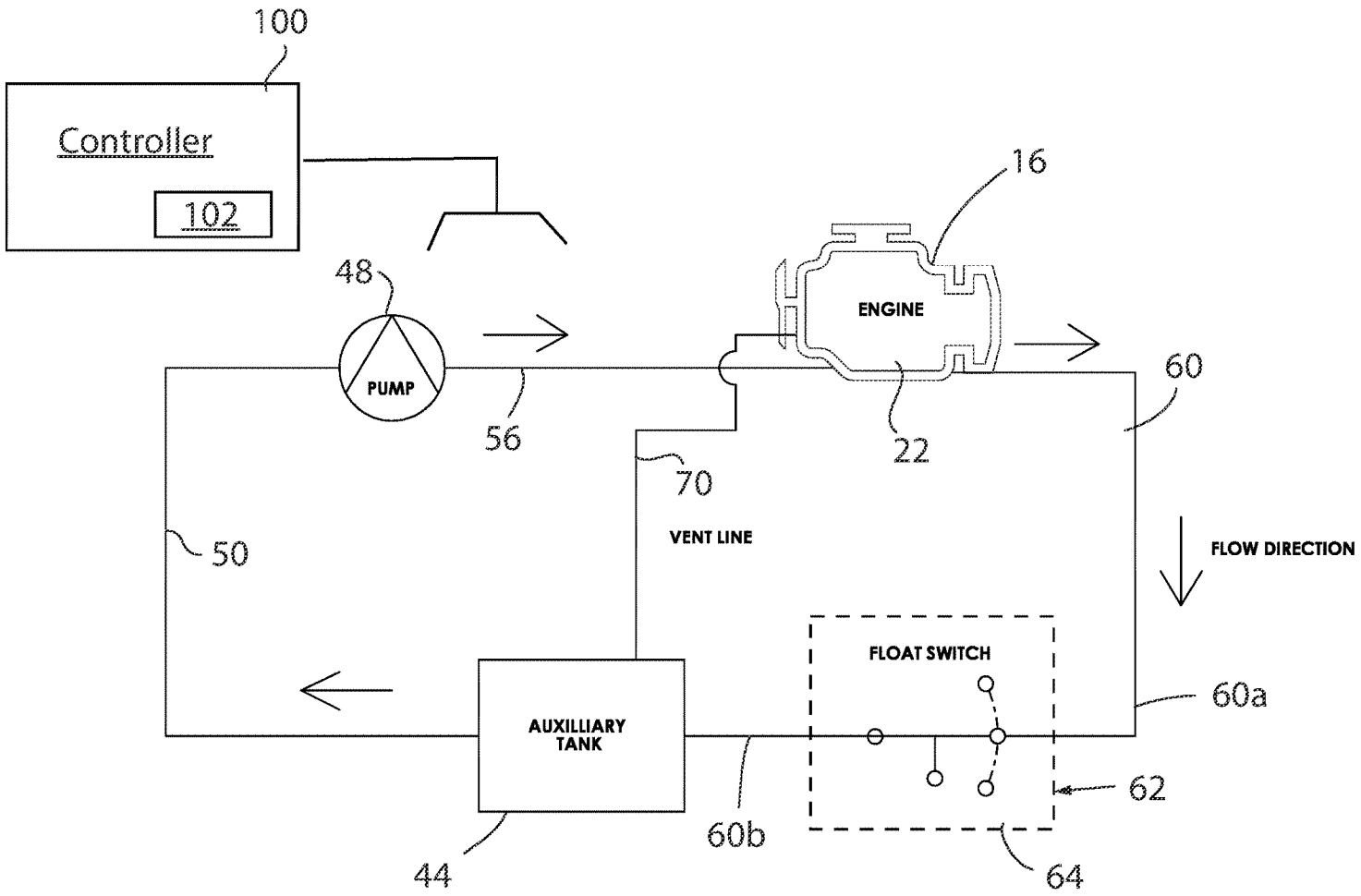
FIG. 5 is another schematic layout of various components within the system.

Referring now to FIG. 4, control system 100 is represented here as configured to provide open loop, timer-based, control of delivering oil from the auxiliary sump 44 (FIG. 3) to the engine sump 22 (FIG. 3). Referring now to FIGS. 4 and 5, timer module 102 is configured to perform time-tracking to evaluate predetermined periods of time at which to maintain the auxiliary oil pump 48 in a deenergized state as well as predetermined periods of time at which energize the auxiliary oil pump 48. Control system 100 typically maintains the auxiliary oil pump 48 deenergized for between about 30 minutes and 120 minutes, more typically between about 45 minutes and 90 minutes, and most typically about 60 minutes. When the control system 100 energizes the auxiliary oil pump, it maintains it in an energized state for between about 1 and 20 seconds, more typically between about 5 and 12 seconds, and more typically for about 5 seconds or most typically for about 10 seconds. During the injection or dosing of oil from auxiliary sump 44 through auxiliary oil pump 48, each oil supplement event typically delivers between about 1 and 5 ounces of oil, more typically between about 1.5 and 3 ounces of oil, and most typically about 1.6 ounces of oil. Furthermore, control system 100 uses switch system 62 to shut off the engine 16 during an engine oil underfill condition or an engine oil overfill condition by deenergizing a fuel pump relay 104 (FIG. 4), which shuts off the fuel supply to the engine's fuel injectors.

Figure 6:
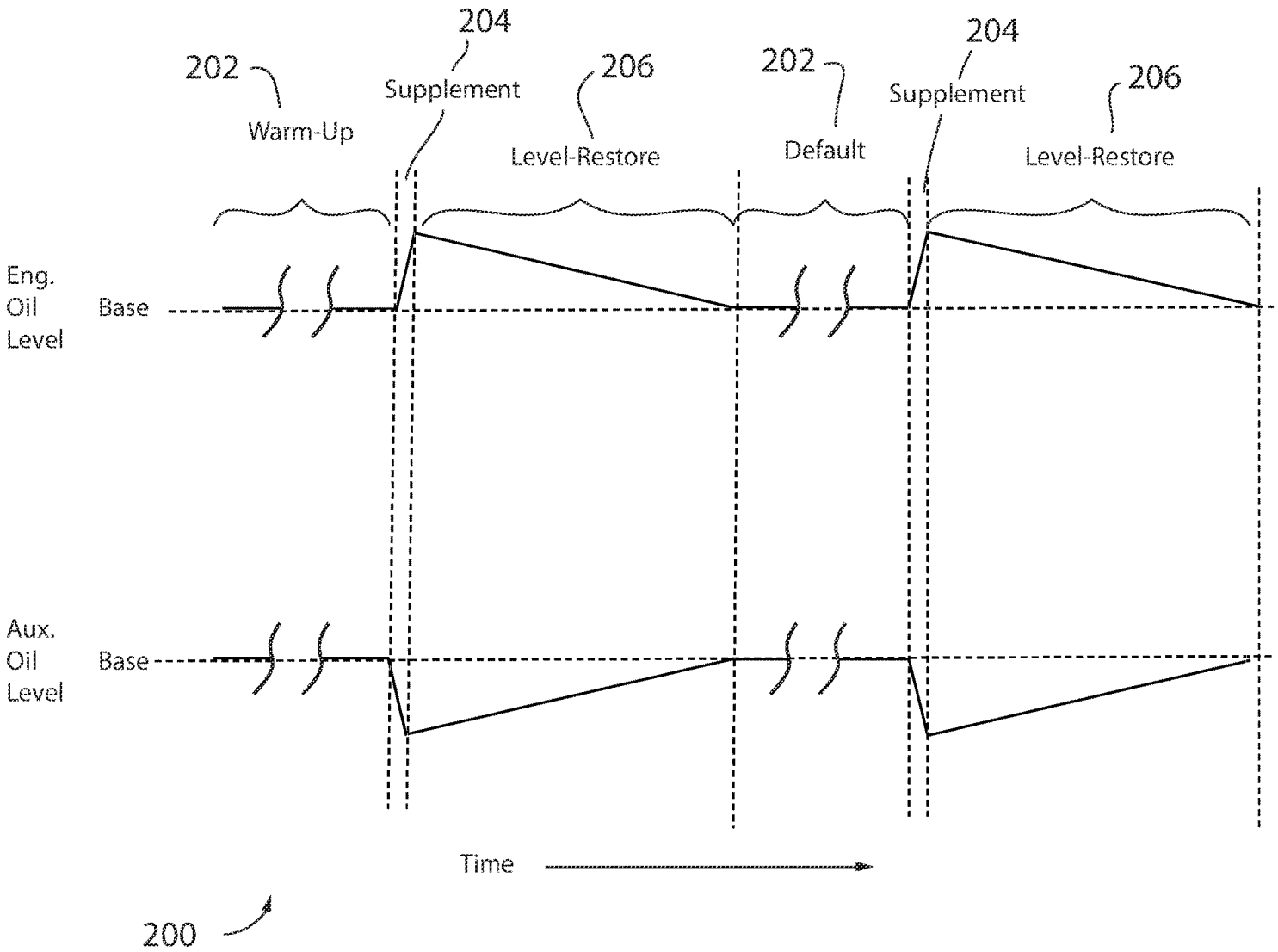
FIG. 6 is graphical representation of various operational characteristics of the system during different operational phases.

Referring now to FIG. 6 and with background reference to the earlier figures for various structures, features, or components, a time graph is shown that represents various phases and events during use procedure 200 of system 10 and corresponding oil levels in the engine sump 22 and auxiliary sump 44. As shown at time period 202, in an initial or warmup phase of operating engine 16, the oil levels are equalized and remain constant between the engine sump 22 and auxiliary sump 44. As represented at time period 204, during an oil supplement event, the auxiliary oil pump 48 is energized, and supplemental oil is removed from the auxiliary volume of oil and added to the primary volume of oil. Correspondingly, during the oil supplement event, the engine sump's 22 oil level increases from an engine sump base oil level to a supplement-increased oil level. An oil level in the auxiliary sump 44 decreases from an auxiliary sump base oil level to a supplement-decreased oil level. Following the oil supplement event, the oils levels passively equalize during a level-restore phase at time period 206. During the level-restore phase, the oil levels in the engine sump 22 and auxiliary sump 44 restore from their temporary supplement-increased and supplement-decreased levels, respectively, to their base levels.

Figure 7:
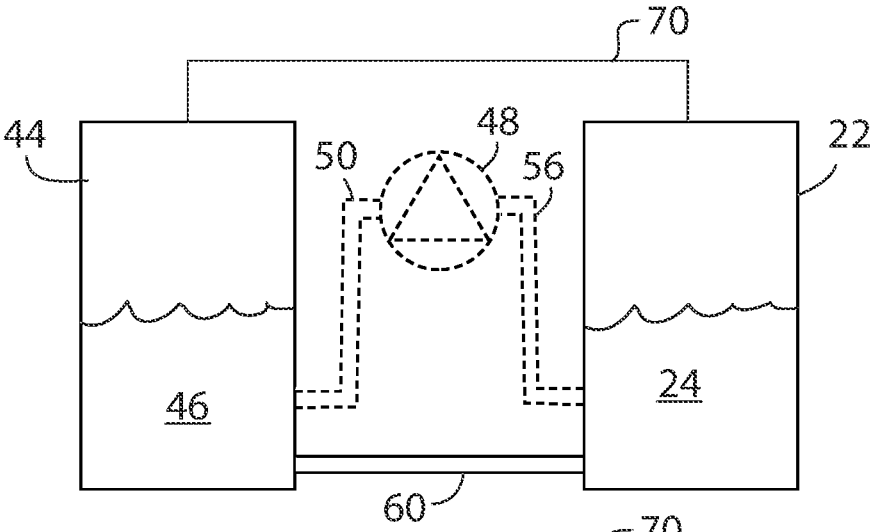
FIG. 7 is a schematic representation of various component statuses during a warmup operational phase of the system.
Figure 8:
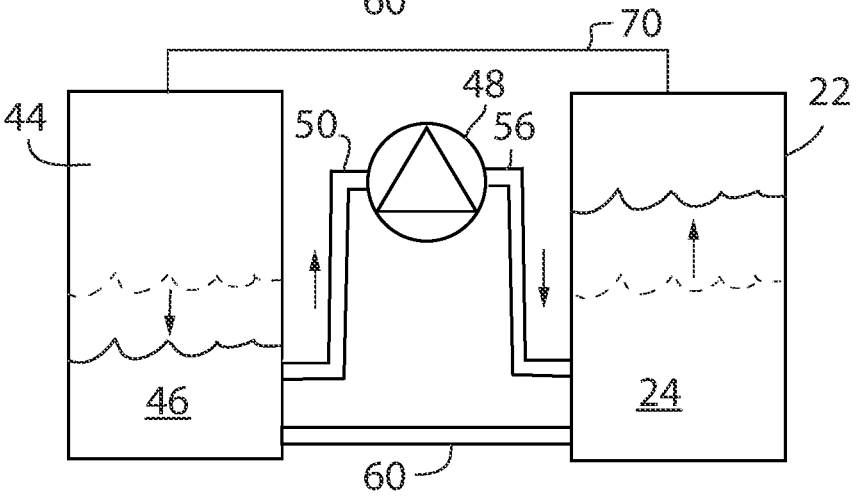
FIG. 8 is a schematic representation of various component statuses during an oil supplement phase of the system.
Figure 9:
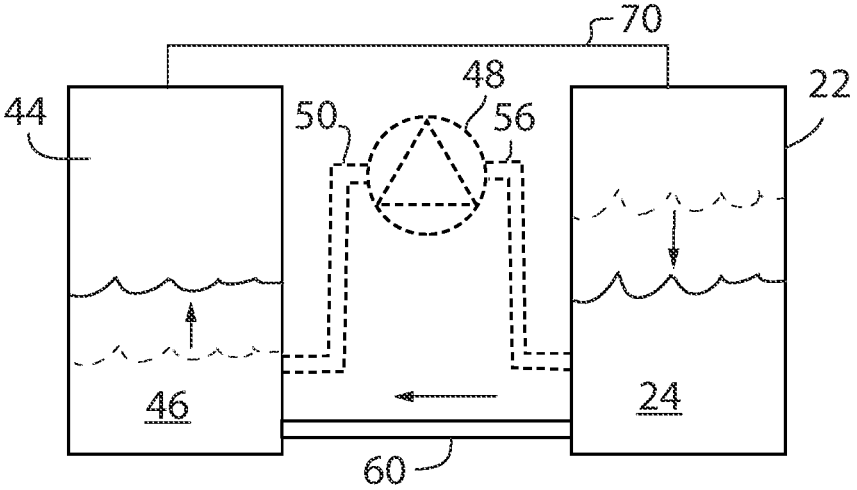
FIG. 9 is a schematic representation of various component statuses during a level-restore phase of the system.

Referring now to FIGS. 7-9, system 10 in FIG. 7 is shown in the default or warmup phase. The auxiliary oil pump 48 is deenergized and the oil levels are equalized between the engine sump 22 and auxiliary sump 44. In FIG. 8, the system 10 is in an oil supplement phase or event. The auxiliary oil pump 48 is energized and an oil level differential is being established between the oil levels in the engine sump 22 and auxiliary sump 44, with the level increasing in the engine sump 22 and decreasing in the auxiliary sump 44. In FIG. 9, the system 10 is in a level-restore phase. The auxiliary oil pump 48 is deenergized, and an oil level differential is being lessened between the oil levels in the engine sump 22 and auxiliary sump 44, with the level decreasing in the engine sump 22 and increasing in the auxiliary sump 44

Although the best mode contemplated by the inventors of carrying out the present invention is disclosed above, practice of the above invention is not limited thereto. It will be manifest that various additions, modifications and rearrangements of the features of the present invention may be made without deviating from the spirit and the scope of the underlying inventive concept.

As indicated above, many changes and modifications may be made to the present invention without departing from the spirit thereof. The scope of some of these changes is discussed above. The scope of others is apparent from the appended claims.

What is claimed is:

1. A lubrication system for an internal combustion engine with an engine oil pan that defines an engine sump holding a primary volume of oil that defines a base oil level in a default state, the lubrication system comprising:

an auxiliary tank that defines an auxiliary sump holding an auxiliary volume of oil;

a sump connector that extends between the engine oil pan and the auxiliary tank and fluidly interconnects the engine sump and the auxiliary sump; and an auxiliary oil delivery system configured to periodically deliver a supplemental volume of oil from the auxiliary sump to the engine sump during an oil supplement event to increase the volume of oil in the engine sump from the base oil level to a supplement-increased oil level.

2. The lubrication system of claim 1, wherein:

the internal combustion engine includes an internal lubrication system having:

engine oil passages that direct oil to lubricate moving components of the internal combustion engine;

an internal oil pump that delivers oil from the engine sump to the engine oil passages;

the auxiliary oil delivery system includes:

an auxiliary oil pump configured to deliver the supplemental volume of oil from the auxiliary sump to the engine sump.

3. The lubrication system of claim 2 wherein the auxiliary volume of oil is greater than the primary volume of oil.

4. The lubrication system of claim 3 wherein auxiliary volume of oil is at least two times the primary volume of oil.

5. The lubrication system of claim 2 wherein multiple flow paths are defined through the lubrication system, including:

a supplemental flow path that flows from the auxiliary sump to the engine sump; and a return flow path that flows from the engine sump to the auxiliary sump.

6. The lubrication system of claim 5 further comprising:

a sump-to-sump return line that connects the engine sump to the auxiliary sump with the return flow path defined through the sump-to-sump return line.

7. The lubrication system of claim 2 further comprising:

a vent that defines a vent passage that fluidly connects an interior of the auxiliary sump to an interior of the internal combustion engine.

8. The lubrication system of claim 7 wherein the vent includes a vent line that extends between and fluidly connects the auxiliary sump and a dipstick tube of the internal combustion engine.

9. The lubrication system of claim 2 further comprising an engine control system that includes:

a switch system configured to:

shut off the engine upon detection of an engine oil underfill condition; and shut off the engine upon detection of an engine oil overfill condition.

10. A method for operating an internal combustion engine at an extended service schedule, the method comprising:

operating an internal combustion engine at a rated operating speed;

circulating a volume oil that defines a default base oil level through a lubricating system of the internal combustion engine to lubricate moving parts of the internal combustion engine;

introducing a supplement volume of oil into the lubricating system of the internal combustion engine during an oil supplement event to provide a supplement-increased oil level that is greater than the base oil level.

11. The method of claim 10, further comprising:

holding a primary volume of oil in an engine sump of the internal combustion engine; and holding a volume of auxiliary oil in an auxiliary sump; and wherein the supplement volume of oil is removed from the volume of auxiliary oil in the auxiliary sump and delivered to the primary volume of oil in the engine sump.

12. The method of claim 11, wherein:

each of the engine sump and the auxiliary sump defines a corresponding base oil level during a default operational state of the internal combustion engine;

during the oil supplement event:

an oil level in the engine sump increases from the engine sump base oil level to a supplement-increased oil level; and an oil level in the auxiliary sump decreases from the auxiliary sump base oil level to a supplement-decreased oil level.

13. The method of claim 12, further comprising:

a level-restore phase during which:

the oil level in the engine sump decreases from the supplement-increased oil level to the engine sump base oil level; and an oil level in the auxiliary sump increases from the supplement-decreased oil level to the auxiliary sump base oil level.

14. A commercial or industrial machine, comprising:

an internal combustion engine with an engine oil pan that defines an engine sump holding a primary volume of oil, and an oil pump configured to circulate the primary volume of oil through the engine during a warmup phase;

a lubrication system that includes:

an auxiliary tank that defines an auxiliary sump holding an auxiliary volume of oil; and an auxiliary oil delivery system that includes an auxiliary pump that is configured to periodically deliver a supplemental volume of oil from the auxiliary sump to the engine sump during an oil supplement event to provide an increased volume of oil in the engine sump, wherein:

following the oil supplement event, the oil pump of the engine circulates the increased volume of oil through the engine; and during a level-restore phase, the increased volume of oil is reduced to approach the primary volume of oil by passively equalizing oil levels of the engine sump and the auxiliary sump.

15. The commercial or industrial machine of claim 14, wherein the lubrication system further comprises:

a sump connector that extends between the engine oil pan and the auxiliary tank and fluidly interconnects the engine sump and the auxiliary sump to provide the passive equalizing of oil levels of the primary volume of oil and the supplemental volume of oil.

16. The commercial or industrial machine of claim 14, wherein multiple flow paths are defined through the lubrication system, including:

a supplemental flow path for delivering oil from the auxiliary sump to the engine sump; and a return flow path that delivering oil from the engine sump to the auxiliary sump.

17. The commercial or industrial machine of claim 16, wherein:

the engine includes an oil pump configured to circulating the primary volume of oil through the engine;

the lubrication system includes an auxiliary pump that actively delivers the supplemental volume of oil from the auxiliary sump to the engine sump; and the return flow path is defined through a sump-to-sump return line and is configured to provide passive equalization of levels of the primary volume of oil and the supplemental volume of oil.

18. The commercial or industrial machine of claim 17, wherein the auxiliary volume of oil is greater than the primary volume of oil.

19. The commercial or industrial machine of claim 18; wherein the internal combustion engine defines a prime mover of a power unit.

20. The commercial or industrial machine of claim 14, wherein the machine comprises one of a mobile generator, a mobile light tower, and a mobile jobsite heater.

* * * * *